United States Patent [19]

Hoyer et al.

[11] Patent Number: 4,647,098

[45] Date of Patent: Mar. 3, 1987

[54] HOIST CLAMP

[75] Inventors: Peter Hoyer, Memmingen; Gerd Ullrich, Memmingerberg, both of Fed. Rep. of Germany

[73] Assignee: Firma Pfeifer Seil-und Hebetechnik GmbH & Co., Memmingen, Fed. Rep. of Germany

[21] Appl. No.: 746,028

[22] Filed: Jun. 18, 1985

[30] Foreign Application Priority Data

Jun. 23, 1984 [DE] Fed. Rep. of Germany ..... 3423314

[51] Int. Cl.[4] ..... B66C 1/44

[52] U.S. Cl. ..... 294/101; 294/104

[58] Field of Search ..... 294/101, 104, 102.1, 294/116, 103.1, 106, 114, 113, 901; 24/241, 248

[56] References Cited

U.S. PATENT DOCUMENTS 3,300,242 1/1967 Renfroe ..... 294/104
4,183,571 1/1980 Renfroe ..... 294/101

FOREIGN PATENT DOCUMENTS 2255629 5/1974 Fed. Rep. of Germany .
2453121 10/1980 Fed. Rep. of Germany .
26310 11/1953 Finland ..... 294/101

*Primary Examiner*—James B. Marbert
*Attorney, Agent, or Firm*—Holman & Stern

[57] ABSTRACT

The hoist clamp has a coupling eye (7) which has a gimbal-type connection by means of the shafts (5,6) to clamp operating crank (14). When a diagonal pull is exerted, the neck (42) of the coupling eye (7) engages against a bracing point (3,4) which is sufficiently high above the shaft (6) to ensure that the lever action provides extra clamping force between the clamps (11,12). When the coupling eye (7) swings about the shaft (5), the coupling eye engages against the upper edges (1,2) of the casing (8), said edges curving outwards, so that additional clamping force is also obtained when the pull exerted is diagonal. Said additional clamping force is only marginally affected by the load (32) held in the load aperture (37).

12 Claims, 2 Drawing Figures

HOIST CLAMP

BACKGROUND OF THE INVENTION

1. Field of the Invention

The present invention relates to a hoist clamp and is concerned particularly with such a clamp for lifting and turning loads and having a casing with a load aperture, a movable and a fixed clamp whereby the movable lever-like clamp is acted upon by arms driven by an eye coupling moved by a universal joint and whereby, in the event of a diagonally exerted pull, the eye coupling is braced against the casing in order, by means of lever action, to increase the clamping force in the clamp.

2. Description of the Prior Art

German reference DE-PS No. 24 53 121 discloses a clamp of the above-mentioned type. The eye coupling is linked to an arm arrangement by a universal joint. The arm arrangement acts on the movable jaw of the clamp. If a diagonal pull is now exerted on the eye coupling, the eye coupling braces itself against the hoist clamp casing, thereby producing a lever action which causes the clamping force between the clamps to increase thereby at least partially compensating for loss of clamping force due to the diagonal direction of the pull.

With a hoist clamp of the type just described the height of the universal joint relative to the parts of the casing against which the eye coupling is braced when a diagonal pull is exerted, depends on the thickness of the load clamped in the jaws of the hoist clamp. If loads are thick, the universal joint with its two shafts is in a lower position, whereas, with slender loads, the universal joint is lifted and pulled clear of the clamp hoist casing.

As a consequence of the difference in height of the universal joint, it is possible to determine beforehand at which point the eye coupling will brace itself against the casing of the hoist clamp. A further consequence is that a case may arise in which the elements of the eye coupling which act in conjunction with the bracing points on the casing lose contact with the casing with the result that, in the case for example, of a slender load, it is not possible to gain sufficient, if any, increase in the clamping force.

However, known devices of this kind rely heavily on the thickness of the load for their effect and as a consequence use an unsafe method of operation in the case of the hoist clamp when loads vary greatly or when different diagonal pulls exerted.

German Patent Specification DE-PS No. 22 55 629 describes a hoist clamp where the movable clamp jaw is connected to an eye coupling by means of a rope which passes over reversing pulleys. From this design it is quite clear that is is possible to produce identical clamping forces even when the direction of pull is diagonal, regardless of the size of the load. Nevertheless, a rope can only be used for special purposes since thick wire ropes will not reverse sufficiently.

The disadvantage caused by the size of the load can be overcome by designing an adjustable fixed clamp. However, a design of this kind demands careful operation which cannot always be guaranteed and which requires additional effort and expense.

BRIEF SUMMARY OF THE INVENTION

An object of the present invention is to provide a hoist clamp where the disadvantageous effects of the size of the load on the clamping force are substantially if not entirely, set aside with the result that, regardless of the size of the load, even when the direction of pull is diagonal, the clamping forces achieved are always sufficient. According to the present invention there is provided a hoist clamp for lifting and turning loads having a casing with a load aperture, a movable and a fixed clamp, the movable clamp being acted upon by arms driven by an eye coupling moved by a universal joint so that in the event of a diagonally exerted pull, the eye coupling is braced against the casing in order, by means of lever action, to increase the clamping force in the clamp, the bracing points of the eye coupling against the casing lying outside the shafts of the universal joint.

In the case of previously known and comparable designs and in particular the clamp described in German reference DE-PS No. 24 53 121 mentioned above, the bracing points between the eye coupling on the one hand and the corresponding parts of the casing on the other are at least partly located in the area between the two shafts of the universal joint to which the eye coupling is connected with the other elements of the hoist clamp. In this design there are cam faces on those parts of the eye coupling which swivel about the external shaft of the universal joint. These cam faces work in conjunction with the upper parts of the casing. Even when there is only a light pull upwards, i.e. in the case of more slender load, the cam face is disengaged from its mating faces. The only way in which it would be possible with this design to prevent the disengagement of those parts of the eye coupling working in conjunction with those of the casing when more slender loads are lifted, would be to increas greatly the external dimensions in order to achieve longer arms of leverage. Even then, however, the degree of success achieved would be only slight.

However, in the present invention, the bracing faces are located outside the joints, or the joints are positioned within the bracing faces, so that, when a pull is exerted upwards, said bracing faces are provided about the universal joints, and therefore it is possible to use a design where the bracing faces are on the casing and on the eye coupling itself, i.e. the opening in which the hoist engages, or the load aperture. If the upper shaft of the universal joint now shifts upwards relative to the casing because of the loads, the degree of movement is relatively small by comparison with the distance available between this shaft and the bracing points. Indeed, in the case of slender loads, this distance is reduced. However, this basically is not a disadvantage since, when a diagonal pull is exerted, the shorter distance only brings about higher forces which increase the more slender the load.

Nor does the present invention suffer from the fact that, in the case of universal joints for hoist clamps of this type, the shafts are at different heights. Indeed, the additional clamping forces achieved by the diagonal pull will be different, regardless of the direction in which said pull is exerted. However, even in the most unfavorable circumstances, the additional clamping forces are high enough to produce a clamping force which is safe. Clearly, leverage is weaker with respect to the bottom universal shaft because the distance between this shaft and the bracing point is greater. However, since the position of the bracing points can be chosen as appropriate, a satisfactory closing force can be produced even in this case.

BRIEF DESCRIPTION OF THE DRAWINGS

The invention will now be described further by way of example with reference to the accompanying drawings wherein.

DETAILED DESCRIPTION

The components of the hoist clamp are mounted in a casing 8 formed by two plates 9 and 10 with links 18, 19, 20 and 21 between them. Links 18 and 19 are plate-like in shape whilst links 20 and 21 are of curved form to create bracing points.

Figure 1:
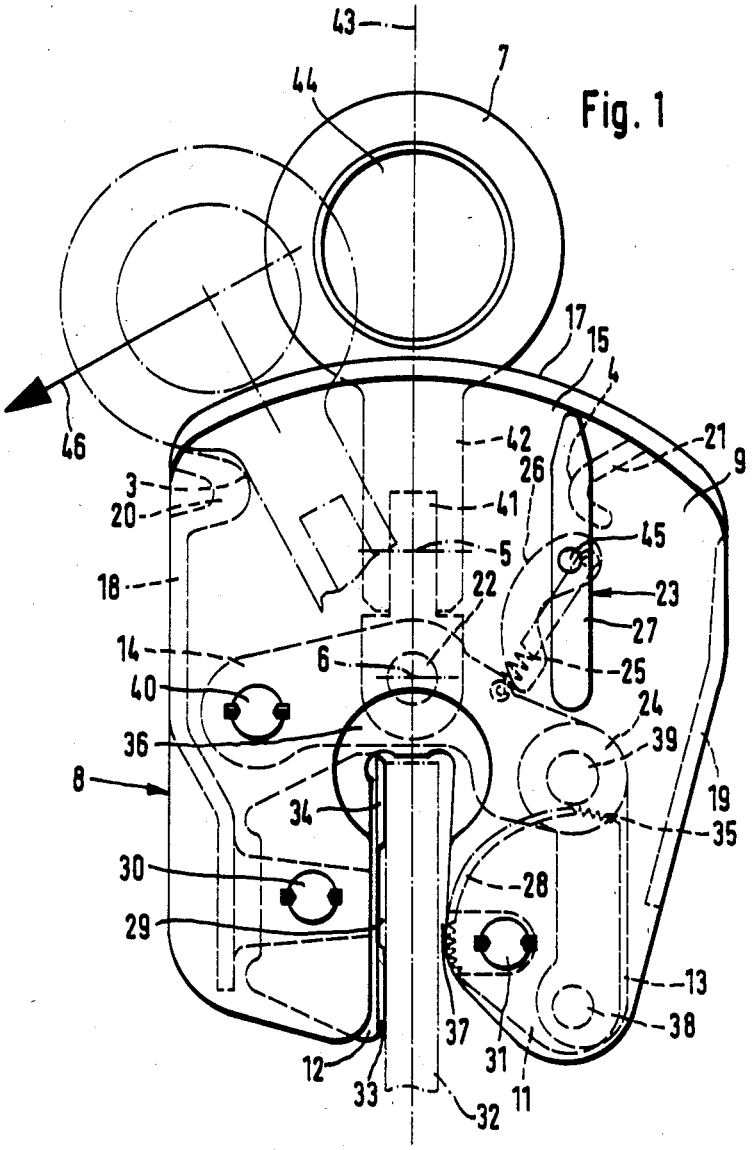
FIG. 1 is an elevational view of the hoist clamp according to the invention.

Clamping jaws 11 and 12 are mounted between the plates 9 and 10. The fixed clamp 12 is held by a pin 30 whilst the movable jaw 11 may swivel about a pin 31. The jaw 11 is cam-shaped such that, when swivelling in a counter-clockwise direction, as seen in FIG. 1, it grips a load shown diagrammatically as 32. Clamping jaw 12 has two serrated areas 33 and 34 with a gap 29 in between so arranged that, without a load attached, the area 35 of the serrations 28 on the clamping jaw 11, engages in the gap 29, thus preventing mutual damage to teeth and serrations. The top part 36 of the gap in which the load is clamped, designated 37, is reinforced.

The clamping jaw 11 is driven by an arm 13 via a pin 38. The arm 13 is connected via a pin 39 to the end 24 of a crank 14 which swivels about a pin 40. The arm 13 and the crank 14 are preferably arranged symmetrically in order to achieve an even distribution of forces.

An eye coupling 7 is connected to the crank 14 by means of a universal joint which consists of an intermediate piece 41 and the two shafts 5 and 6 with the pin 22 of the shaft 6 directly located in the crank 14. The shaft 5 runs parallel to the planes of the surfaces of the plates 9 and 10, while the shaft 6 is positioned perpendicularly to it. If an upward pull is applied to the eye coupling 7, the clamping jaw 11 moves into a closed position so that the height of the universal joint shafts 5 and 6 depends on the load 32.

In the event of a pull applied diagonally to the coupling, it swivels about shaft 6 (as shown in a dot-dash line in FIG. 1), and a component of force operates in the direction indicated by the arrow 46, the eye and neck 42 of the eye coupling engages a bracing point 3 on the link 20. If a pull is exerted in the opposite direction, the neck 42 engages the bracing point 4 of the link 21. The eye coupling 7 with the intermediate piece 41 is now operating like a double-arm lever, whereby the pin in the shaft 6 is drawn upwards and the closing force between the jaws 11 and 12 is increased. Because of the relatively large distance between the bracing points 3, 4 and the shaft 6, which is a significant result of the invention, good closing forces are always obtained.

Figure 2:
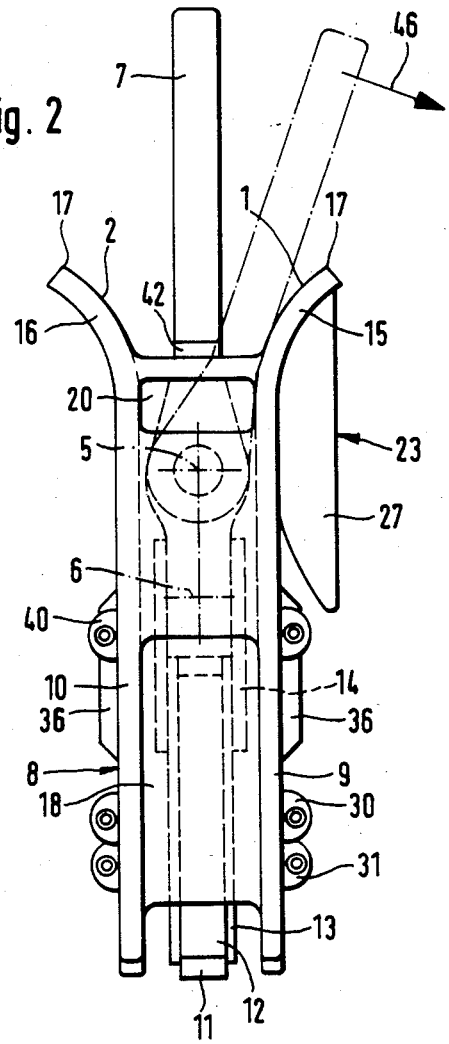
FIG. 2 is a left side elevation view of the hoist clamp shown in FIG. 1.

FIG. 2 shows that the upper ends 15 and 16 of the plates 9 and 10 curve outwards. The curve may have a constant radius, thus forming a surface which is predominantly cylindrical. However, curves of a non-union radius are also possible and in particular curves in which the radius decreases towards the free end or others where a tight curve is followed by a curve with a large radius towards the free end. The result is that, in the event of a diagonal pull, as shown in FIG. 2 in which the eye coupling 7 is shown in a dot-dash line bracing points 1 and 2 are obtained which move further upwards the more elevated the height of the shaft 5. Again, the height depends on the size of the load 32. There are therefore always lever arms which can be used to exert tensile forces on the intermediate piece 41 through the pin of shaft 5. These tensile forces are transferred via the intermediate piece 41 to the linkage 14, 13 and then to the jaw 11 of the clamp.

In the illustrated embodiment, the eye coupling 7 is guided by the crank 14 so that the shaft 6 moves in an arc around the pin 40. It has been found that this design produces useful results, although it is clear that, because of the swinging movement of the crank 14, the shaft 6 does not always remain on the center line 43 but moves rather to the side. Obviously, a slot-like guide or a similar means can be provided for the pin 6 to exclude lateral movements if the connection between the shaft 6 and the pin 40 is effected in a different way. The design illustrated has however the advantage that pin joints can be used which are easy to make on the one hand and, on the other, move with less friction. By shaping the contours of the bracing points 3 and 4 changes can still be made, if so desired, to the lever arms.

As can be seen in FIG. 1, the top edge 17 of plates 9 and 10 is chamfered, the radius of the chamfer corresponding approximately to the distance between the inside shaft 6 of the universal joint and the edge of the plate. The chamfer may also be somewhat flatter. In this manner good use is made of the available height as far as the opening 44 of the eye 7.

A clamp actuator 23 is mounted on the plate and consists of a toggle-type handle 27 on the outside of plate 9 and a cam 26 on the inside of the plate 9. The cam 26 swivels about the shaft 45. A spring 25 is also provided, one end of which is secured to crank 14, while the other end is fixed to the inside of the plate 9 or even to the cam 25 near to shaft 45.

In the position depicted by FIG. 1, the clamp actuator 23 is in a position in which the cam 26 pushes the crank 14 downwards, thus forcing the jaw 11 into the open position. If the toggle-type handle is turned in a counter-clockwise direction, the spring 25 causes the crank to swing in a counter-clockwise direction about pin 40, during which movement the clamp moves into the closed position.

An advantage is that both the cam 26 and also the toggle-type handle 27 lie within the contours of the plates 9 and 10, the plates being so designed in relation to the swivel range of the toggle-type handle 27 that, even when the hoist clamp is in a horizontal position, neither the load nor other obstacles hinder the operation of the handle 27. Additional protection is afforded the handle by the curvature of the top edges of the plate.

I claim:

1. A hoist clamp for lifting and turning loads comprising:

a casing comprised of two spaced casing elements, connecting parts rigidly connecting said casing elements together, and a load aperture in the space between said casing elements for receiving a load;

a fixed clamping jaw mounted in said casing;

load engaging means on said fixed clamping jaw in said load aperture;

a movable clamping jaw mounted in said casing for movement relative to said fixed clamping jaw;

load engaging means on said movable clamping jaw in said load aperture for movement with said movable clamping jaw relative to said load engaging means on said fixed clamping jaw for clamping the load between said load engaging means;

movable arm means in said casing between said spaced element operatively connected to said movable clamping jaw so that movement of said arm means moves said movable clamping jaw between load engaging and disengaging positions;

an eye coupling member;

a universal joint connecting said eye coupling member to said movable arm means and having two shafts, one of said shafts having a central axis extending substantially parallel to the direction of movement of said load engaging means on said movable clamping jaw, said universal joint being movable relative to said clamping jaws;

bracing points on said casing spaced from said universal joint shafts for engaging said eye coupling member when a diagonal force, at an angle to the direction of the force of the load, is exerted on said eye coupling member, so that a lever action is produced on said eye coupling member for increasing the clamping force of said load engaging means on said load; and curved surfaces on said spaced casing elements at the portions thereof near said eye coupling member, some of said bracing points being on said curved surfaces so that the engagement of said eye coupling member with said curved surfaces moves upwardly proportionally to the movement of said universal joint in the direction away from said clamping jaws.

2. A hoist clamp as claimed in claim 1 wherein:

said portions of said casing element on which said curved surfaces are disposed have chamfered edges.

3. A hoist as claimed in claim 2 wherein:

said chamfered edges have a radius approximately equal to the distance between said chamfered edges and the central axis of the other shaft of said universal joint engaging said movable arm means.

4. A hoist clamp as claimed in claim 1 wherein said casing elements are connected together by links located between said elements; and said bracing points engageable by said eye coupling member when said eye coupling member is pulled diagonally in a direction perpendicular to the plane containing said axis of said one shaft are on portions of said links through which said eye coupling member extends.

5. A hoist clamp as claimed in claim 1 wherein:

said movable arm means comprise:

a crank arm having one end pivotally connected to said casing and a free end, said universal joint being mounted to said crank arm between said ends of said crank arm; and a link arm pivotally connecting said free end to said movable clamping jaw.

6. A hoist clamp as claimed in claim 3 wherein:

said casing elements are connected together by links located between said elements; and said bracing points engageable by said eye coupling member when said eye coupling member is pulled diagonally in a direction perpendicular to the plane containing said axis of said one shaft are on portions of said links through which said eye coupling member extends.

7. A hoist clamp as claimed in claim 4 wherein:

said movable arm means comprise:

a crank arm having one end pivotally connected to said casing and a free end, said universal joint being mounted to said crank arm between said ends of said crank arm; and a link arm pivotally connecting said free end to said movable clamping jaw.

8. A hoist clamp as claimed in claim 1 and further comprising:

a clamping jaw actuator pivotally mounted on one of said casing elements for movement between actuating and non-actuating positions;

a spring means connected between said movable arm means and said one of said casing elements for urging said movable clamping jaw toward the clamping position; and an acutuator cam connected to said actuator and engageable with said movable arm means in the non-actuating position to hold said movable clamping jaw in a retracted non-clamping position and disengaged from said movable arm means in the actuating position.

9. A hoist clamp as claimed in claim 5 and further comprising:

a clamping jaw actuator pivotally mounted on one of said casing elements for movement between actuating and non-actuating positions;

a spring means connected between said crank arm and said one of said casing elements for urging said movable clamping jaw toward the clamping position; and an actuator cam connected to said actuator and engageable with said crank arm in the non-actuating position to hold said movable clamping jaw in a retracted non-clamping position and disengaged from said movable arm means in the actuating position.

10. A hoist clamp as claimed om claim 8, wherein:

said clamping jaw actuator comprises a toggle-type handle on the outside of said one of said casing elements;

said actuator arm is disposed in the space between said casing elements; and said handle and said arm move within contours of said casing elements.

11. A hoist clamp as claimed in claim 1 wherein:

said load engaging means on said fixed clamping jaw comprises two spaced sections of teeth providing a gap between said sections, and said load engaging means on said movable clamping jaw comprises serrations which are engageable in said gap in the clamping position with no workpiece in said load aperture.

12. A hoist clamp as claimed in claim 1 wherein:

said casing elements comprise plate members.

* * * * *